US006846340B2

(12) United States Patent
Yoshida et al.

(10) Patent No.: US 6,846,340 B2
(45) Date of Patent: Jan. 25, 2005

(54) METHOD OF MANUFACTURING SEGMENT-CHIP-TYPE GRINDING WHEEL HAVING LARGE AXIAL LENGTH

(75) Inventors: Kazumasa Yoshida, Niwa-gun (JP); Takeshi Nonogawa, Toki (JP); Yasuteru Kubota, Nagoya (JP)

(73) Assignee: Noritake Co., Ltd., Nagoya (JP)

( * ) Notice: Subject to any disclaimer, the term of this patent is extended or adjusted under 35 U.S.C. 154(b) by 0 days.

(21) Appl. No.: 10/295,955

(22) Filed: Nov. 18, 2002

(65) Prior Publication Data

US 2004/0211123 A1 Oct. 28, 2004

(30) Foreign Application Priority Data

Nov. 21, 2001 (JP) ..... 2001-355926

(51) Int. Cl.[7] ..... B24D 18/00

(52) U.S. Cl. ..... 51/297; 51/295; 51/307; 51/308; 51/309; 51/293

(58) Field of Search ..... 51/295, 297, 307, 51/308, 309, 293

(56) References Cited

U.S. PATENT DOCUMENTS 6,074,278 A * 6/2000 Wu et al. ..... 451/28

6,102,789 A * 8/2000 Ramanath et al. ..... 451/541

FOREIGN PATENT DOCUMENTS

DE 102 08 423 A1 10/2002

* cited by examiner

*Primary Examiner*—Michael Marcheschi
(74) *Attorney, Agent, or Firm*—Oliff & Berridge, PLC

(57) ABSTRACT

A method of manufacturing a grinding wheel which includes a cylindrical core body and a plurality of part-cylindrical abrasive segment chips bonded to an outer circumferential surface of the cylindrical core body. The method includes: a firing step of firing an unfired part-cylindrical precursor to prepare each part-cylindrical abrasive segment chips, by using a supporting member whose coefficient of thermal expansion is different from that of each abrasive segment chip; and a bonding step of bonding the abrasive segment chips to the outer circumferential surface of the cylindrical core body with an adhesive interposed therebetween, by forcing each abrasive segment chip against the outer circumferential surface of the cylindrical core body, such that a force acting on the outer circumferential surface of the cylindrical core body is evenly distributed in an axial direction of the cylindrical core body while the adhesive is being hardened.

12 Claims, 10 Drawing Sheets

METHOD OF MANUFACTURING SEGMENT-CHIP-TYPE GRINDING WHEEL HAVING LARGE AXIAL LENGTH

BACKGROUND OF THE INVENTION

1. Field of the Invention

The present invention relates in general to a method of manufacturing a grindstone or grinding wheel including a cylindrical core body and a plurality of abrasive segment chips which are fixed to an outer circumferential surface of the cylindrical core body.

2. Discussion of the Related Art

There is known a segment-chip-type grinding wheel including: a cylindrical core body; and a plurality of abrasive segment chips which have respective abrasive layers and which are fixed to an outer circumferential surface of the cylindrical core body. In a grinding operation with this grinding wheel, the grinding wheel is rotated about an axis of the cylindrical core body, so that a workpiece is ground by the abrasive layer of each abrasive segment chip. The abrasive layer has a longer service life where the abrasive layer is formed of so-called "super abrasive grains" such as diamond abrasive grains and CBN (cubic boron nitrides) abrasive grains, than where the abrasive layer is formed of standard abrasive grains such as alumina abrasive grains and silicone carbide abrasive grains. Where the abrasive layer is formed of the super abrasive grains, the abrasive layer has a relatively small thickness, in general, due to a relative expensiveness of the super abrasive grains. The segment-chip-type grinding wheel having such a construction is widely used in various fields, while being studied for the purpose of further increasing its grinding performance. One example of such a segment-chip-type grinding wheel is described in the specification of the Japanese Patent Application 2001-053927 (corresponding to the U.S. patent application Ser. No. 10/080,686 and the German Patent Application No. 102 08 423.8), in which the abrasive segment chips are arranged in such a manner that effectively prevents a chattering or self-induced vibration in the grinding operation.

FIG. 1 is a perspective view showing a grinding wheel 10, as one example of the conventional segment-chip-type grinding wheel, in which a multiplicity of part-cylindrical or arcuate abrasive segment chips 12 are fixed to an outer circumferential surface of a cylindrical core body 14. As is apparent from FIG. 1, a plurality of the abrasive segment chips 12 are arranged as viewed in the circumferential direction of the cylindrical core body 14 and also as viewed in the axial direction of the cylindrical core body 14. FIG. 2 is a perspective view showing a grinding wheel 20, as another example of the conventional segment-chip-type grinding wheel, in which the arcuate abrasive segment chips 12 are fixed to the outer circumferential surface of the cylindrical core body 14. The grinding wheel 20 is different from the grinding wheel 10 in that the abrasive segment chips 12 include relatively long segment chips and relatively short segment chips which are alternately arranged.

The conventional segment-chip-type grinding wheels such as the above-described grinding wheels 10, 20 are widely used in a centerless grinding operation in which a cylindrical workpiece is not supported on its centers but rather by a work rest blade, a regulating wheel, and the grinding wheel. FIG. 3 is a view illustrating a thru-feed centerless grinding operation in which an outer circumferential surface of a cylindrical workpiece 22 is grounded by the grinding wheel 10. The workpiece 22, which is disposed on a work rest blade 16 and is guided by a work rest guides 18, is continuously fed in a longitudinal direction as indicated by the arrow, while being gripped by and between the grinding wheel 10 and the regulating wheel 24. The regulating wheel 24 is rotated for rotating workpiece 22 at a relatively low speed, while the grinding wheel 10 is rotated at a relatively high speed, whereby the outer circumferential surface of the workpiece 22 is grounded by the grinding wheel 10.

FIG. 4 is a view illustrating an infeed centerless grinding operation in which a cylindrical workpiece 26 having a shoulder is grounded by the grinding wheels 20 and a grinding wheel 32 which has a diameter smaller than that of the grinding wheel 20. A small diameter portion of the workpiece 26 is gripped by and between the grinding wheel 20 and a regulating wheel 30, while a large diameter portion of the workpiece 26 is gripped by and between the grinding wheel 32 and a regulating wheel 34 which has a diameter smaller than that of the regulating wheel 30. The regulating wheels 30, 34 are rotated for rotating workpiece 26 at a relatively low speed, while the grinding wheels 20, 32 are rotated at a relatively high speed and are fed in a transversal direction toward and away from the workpiece 26 as indicated by the arrows, whereby the outer circumferential surface of the workpiece 26 is grounded by the grinding wheel 10. It is noted that reference numeral 28 denotes a stopper which is provided to position the workpiece 26 in a predetermined longitudinal position relative to the grinding wheels 20, 32.

However, there have been discussed problems which could be caused in a centerless grinding operation with the conventional segment-chip-type grinding wheel 10 or 20 in which a plurality of the abrasive segment chips 12 are arranged as viewed in the axial direction of the cylindrical core body 14, namely, in a direction perpendicular to an end face of the cylindrical core body 14. For example, in the thru-feed centerless grinding operation shown in FIG. 3, there is a possibility that the workpiece 22 could jump upon its contact with a joint clearance or joint line between the adjacent abrasive segment chips 12 while being fed across the grinding wheel 10 and the regulating wheel 24. That is, there is a risk that the grinding wheel 10 could be damaged by the jumping workpiece. Further, in the infeed centerless grinding operation shown in FIG. 4, there is a possibility that the ground workpiece 26 could suffer from a low degree of roundness and undesirable marks generated on the ground surface, if there is a gap or clearance between the adjacent abrasive segment chips 12, or if there is an adhesive (which was used for bonding the abrasive segment chips 12 to the cylindrical core body 14) sticking to a grinding surface which is constituted by surfaces of the abrasive segment chips 12. Although there have been practiced various manners for preventing the adhesive from being exposed on the grinding surface, it is extremely difficult to completely eliminate the adhesive exposed on the grinding wheel. Particularly, in the segment-chip-type grinding wheel 10 or 20 in which the joint lines extend not only in the axial direction but also in the circumferential direction, it is practically impossible to eliminate the adhesive exposed on the grinding wheel.

The above-described problems might be solved by employing a segment-chip-type grinding wheel 50, as shown in FIG. 9, which has joint lines extending in the axial direction but does not have any joint line extending in the circumferential direction, namely, which has part-cylindrical abrasive segment chips 52 each extending over the entire axial length of the cylindrical core body 14.

However, this segment-chip-type grinding wheel 50 is difficult to be produced by conventional techniques, due to a considerably large length of each abrasive segment chip 52. That is, there is no conventional technique for satisfactorily firing unfired precursor to prepare such an abrasive segment chip 52 having the considerably large length, as shown in FIG. 5.

FIGS. 6 and 7 show conventional arrangements for firing unfired part-cylindrical precursor 54 to prepare the abrasive segment chip 52. In FIG. 6, the unfired part-cylindrical precursor 54 is disposed or stood on a setter 56 consisting of a flat plate such that the part-cylindrical precursor 54 is held in contact at one of lengthwise opposite end faces with a flat surface of the setter 56. In FIG. 7, the unfired part-cylindrical precursor 54 is disposed or stood on the setter 56 such that the part-cylindrical precursor 54 is held in contact at one of widthwise opposite end faces with the flat surface of the setter 56. However, since the precursor 54 is inevitably softened in the firing process, the precursor 54 is likely to be deformed due to its own weight in either one of the arrangements of FIGS. 6 and 7. In the arrangement of FIG. 6, the precursor 54 tends to be bent in the longitudinal direction. In the arrangement of FIG. 7, the precursor 54 tends to be bent in the width direction. Such a deformation of the precursor 54 makes it impossible to satisfactorily bond the precursor 54 to the cylindrical core body 14.

FIG. 8 shows another arrangement for firing the unfired part-cylindrical precursor 54. In this arrangement, the above-described setter 56 consisting of the flat plate is replaced with a setter 58 having a part-cylindrical surface 58*t* whose radius of curvature is substantially equal to that of a radially inner surface of the part-cylindrical precursor 54, so that precursor 54 can be disposed or laid on the setter 58 such that the part-cylindrical precursor 54 is held in close contact at the radially inner surface with the part-cylindrical surface 58*t*. Although this arrangement is effective to prevent the deformation of the precursor 54, the precursor 54 is likely to adhere to the setter 58 due to the close contact.

FIG. 11 shows a conventional arrangement for bonding the part-cylindrical abrasive segment chip 52 to the cylindrical core body 14. In this arrangement, the core body 14, the abrasive segment chip 52 and a magnet block 62 are disposed on a base plate 60 made of a metal such as a steel. The magnet block 62 is moved to force the abrasive segment chip 52 against the outer circumferential surface of the core body 14, such that the abrasive segment chip 52 is held in contact with the outer circumferential surface of the core body 14 via an adhesive. That is, the contact of the abrasive segment chip 52 with the core body 14 via the adhesive is held by the magnet block 62 which is fixed to the base plate 60 owing to a magnetic force, until the hardening of the adhesive is completed. This arrangement suffers from a problem that the abrasive segment chip 52 can not be satisfactorily bonded to the core body 14, even where the segment chip 52 is distorted or bent by a small amount.

As discussed above, there does not exist a satisfactory method of manufacturing a segment-chip-type grinding wheel with abrasive segment chips each having a large axial length, namely, a segment-chip-type grinding wheel with segment chips each extending over an entire axial length of the grinding wheel, although there is a demand for such a manufacturing method.

SUMMARY OF THE INVENTION

The present invention was made in the light of the background art discussed above. It is therefore an object of the present invention to provide a method of manufacturing a grinding wheel which includes a cylindrical core body and a plurality of part-cylindrical abrasive segment chips each bonded to an outer circumferential surface of the cylindrical body and each having a large axial length, more preferably, a method of manufacturing a grinding wheel including a cylindrical core body and a plurality of part-cylindrical abrasive segment chips each bonded to an outer circumferential surface of the cylindrical body and each extending over an entire axial length of the grinding wheel. This object of the invention may be achieved according to any one of the first through thirteenth aspects of the invention which are described below.

The first aspect of this invention provides a method of manufacturing a grinding wheel which includes a cylindrical core body and a plurality of part-cylindrical abrasive segment chips bonded to an outer circumferential surface of the cylindrical core body, the method comprising: a forming step of forming an unfired part-cylindrical precursor for each of the part-cylindrical abrasive segment chips; and a firing step of firing the unfired part-cylindrical precursor to prepare each of the part-cylindrical abrasive segment chips, by using a supporting member which has a part-cylindrical surface, wherein the unfired part-cylindrical precursor is fired, while being supported by the supporting member such that the unfired part-cylindrical precursor is held in contact at a part-cylindrical surface thereof with the part-cylindrical surface of the supporting member, and wherein the supporting member is made of a material having a coefficient of thermal expansion which is different from a coefficient of thermal expansion of each of the part-cylindrical abrasive segment chips.

In the method according to this first aspect of the invention in which the unfired part-cylindrical precursor is fired while being supported by the supporting member made of the material having the coefficient of thermal expansion that is sufficiently different from the coefficient of thermal expansion of each of the part-cylindrical abrasive segment chips, it is possible to prevent the part-cylindrical precursor from adhering to the supporting member, with which the part-cylindrical surface of the part-cylindrical precursor is held in close contact during the firing step.

According to the second aspect of the invention, in the method defined in the first aspect of the invention, the coefficient of thermal expansion of the material of the supporting member is different from the coefficient of thermal expansion of each of the part-cylindrical abrasive segment chips, by an amount large enough to prevent the unfired part-cylindrical precursor from adhering to the supporting member.

According to the third aspect of the invention, in the method defined in the first aspect of the invention, the coefficient of thermal expansion of the material of the supporting member is larger than the coefficient of thermal expansion of each of the part-cylindrical abrasive segment chips, by an amount large enough to prevent the unfred part-cylindrical precursor from adhering to the supporting member.

According to the fourth aspect of the invention, in the method defined in any one of the first through third aspects of the invention, each of the part-cylindrical abrasive segment chips extends over an axial length of the grinding wheel, so that there does not exist any joint line extending in a circumferential direction of the grinding wheel.

According to the fifth aspect of the invention, in the method defined in any one of the first through fourth aspects of the invention, each of the part-cylindrical abrasive segment chips includes an abrasive layer having a vitrified abrasive structure in which diamond abrasive grains are held together by a vitrified bond.

According to the sixth aspect of the invention, in the method defined in any one of the first through fourth aspects of the invention, each of the part-cylindrical abrasive segment chips includes an abrasive layer having a vitrified abrasive structure in which CBN abrasive grains are held together by a vitrified bond.

According to the seventh aspect of the invention, in the method defined in any one of the first through sixth aspects of the invention, the material of the supporting member is alumina.

According to the eighth aspect of the invention, the method defined in any one of the first through seventh aspects of the invention further comprises: a bonding step of bonding the abrasive segment chips to the outer circumferential surface of the cylindrical core body with an adhesive interposed therebetween, by forcing each of the abrasive segment chips against the outer circumferential surface of the cylindrical core body, such that a force acting on the outer circumferential surface of the cylindrical core body is evenly distributed in an axial direction of the cylindrical core body while the adhesive is being hardened.

In the method according to this eighth aspect of the invention, each of the abrasive segment chips is forced against the outer circumferential surface of the cylindrical core body such that the force acting on the outer circumferential surface of the cylindrical core body is evenly distributed in the axial direction in the process of hardening of the adhesive. This arrangement makes it possible to satisfactorily bond each abrasive segment chip to the outer circumferential surface of the core body even where the abrasive segment chip is slightly distorted or bent.

The ninth aspect of this invention provides a method of manufacturing a grinding wheel which includes a cylindrical core body and a plurality of part-cylindrical abrasive segment chips bonded to an outer circumferential surface of the cylindrical core body, the method comprising: a bonding step of bonding the abrasive segment chips to the outer circumferential surface of the cylindrical core body with an adhesive interposed therebetween, by forcing each of the abrasive segment chips against the outer circumferential surface of the cylindrical core body, such that a force acting on the outer circumferential surface of the cylindrical core body is evenly distributed in an axial direction of the cylindrical core body while the adhesive is being hardened.

The method of this ninth aspect of the invention provides substantially the same technical advantage as the above-described method of the eighth aspect of the invention.

According to the tenth aspect of the invention, in the method defined in the ninth aspect of the invention, each of the abrasive segment chips is forced against the outer circumferential surface of the cylindrical core body, by using a holding member which includes a main body portion and an elastic portion, and wherein the holding member is brought into contact at the elastic portion with each of the abrasive segment chips, and is moved to force each of the abrasive segment chips against the outer circumferential surface of the cylindrical core body.

According to the eleventh aspect of the invention, in the method defined in the ninth or tenth aspect of the invention, each of the part-cylindrical abrasive segment chips extends over an axial length of the grinding wheel, so that there does not exist any joint line extending in a circumferential direction of the grinding wheel.

According to the twelfth aspect of the invention, in the method defined in any one of the ninth through eleventh aspects of the invention, each of the part-cylindrical abrasive segment chips includes an abrasive layer having a vitrified abrasive structure in which diamond abrasive grains are held together by a vitrified bond.

According to the thirteenth aspect of the invention, in the method defined in any one of the ninth through eleventh aspects of the invention, each of the part-cylindrical abrasive segment chips includes an abrasive layer having a vitrified abrasive structure in which CBN abrasive grains are held together by a vitrified bond.

BRIEF DESCRIPTION OF THE DRAWINGS

The above and other objects, features, advantages and technical and industrial significance of this invention will be better understood by reading the following detailed description of the presently preferred embodiment of the invention, when considered in connection with the accompanying drawings, in which.

DETAILED DESCRIPTION OF THE PREFERRED EMBODIMENT

Figure 9:
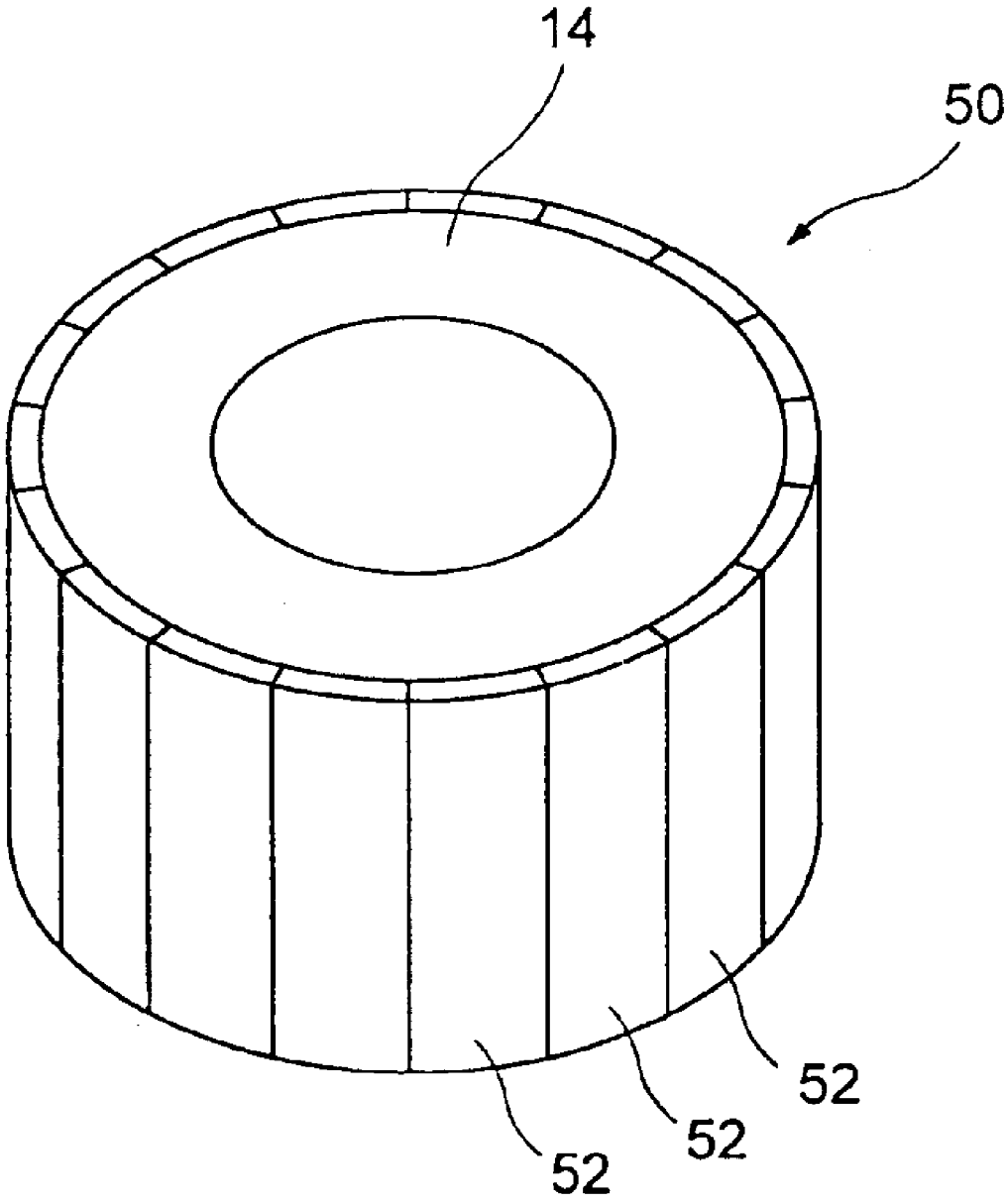
FIG. 9 is a perspective view of a segment-chip-type grinding wheel manufactured by the method according to the embodiment of the invention.

FIG. 9 is a perspective view of the segment-chip-type grinding wheel 50 which has been manufactured by a manufacturing method according to an embodiment of the invention. The grinding wheel 50 consists of a cylindrical body having an axial through-hole, and has an outside diameter of 400 mm, an axial length (thickness) of 200 mm and an inside diameter of 200 mm. The segment-chip-type grinding wheel 50 has the plurality of arcuate or part-cylindrical abrasive segment ships 52 which are bonded at their inner surfaces to the outer circumferential surface of the cylindrical core body 14 by an adhesive, such that the abrasive segment chips 52 are arranged in the circumferential direction without substantially no gap between each adjacent ones of the abrasive segment chips 52. The inner surface of each of the part-cylindrical abrasive segment chips 52 has substantially the same radius of curvature as the outer circumferential surface of the cylindrical core body 14. Each abrasive segment chip 52 has a length of 200 mm, and extends over the entire axial length of the cylindrical core body 14, so that there does not exist any joint line extending in a circumferential direction of the grinding wheel 52.

Figure 5:
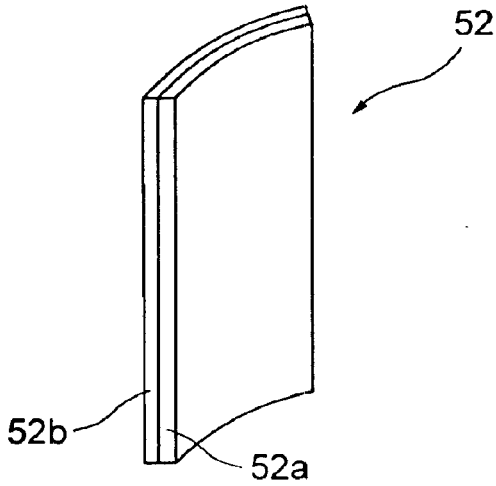
FIG. 5 is a perspective view of an abrasive segment chip having a large length.
Figure 6:
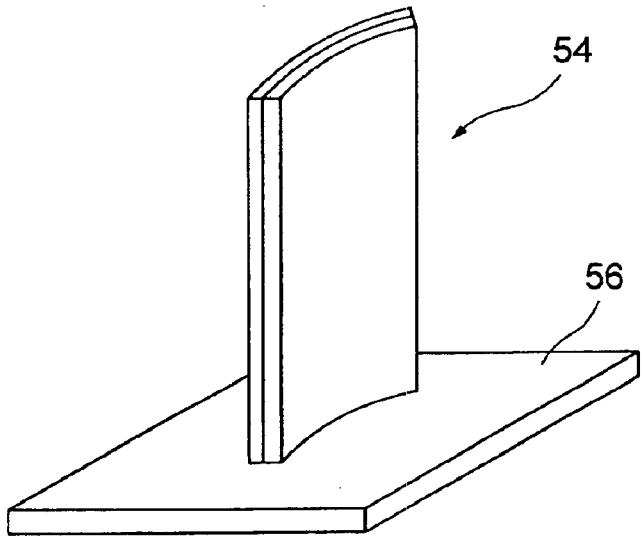
FIG. 6 PRIOR ART
FIG. 6 is a perspective view of one example of conventional firing step of firing an unfired precursor to prepare the abrasive segment chip.
Figure 7:
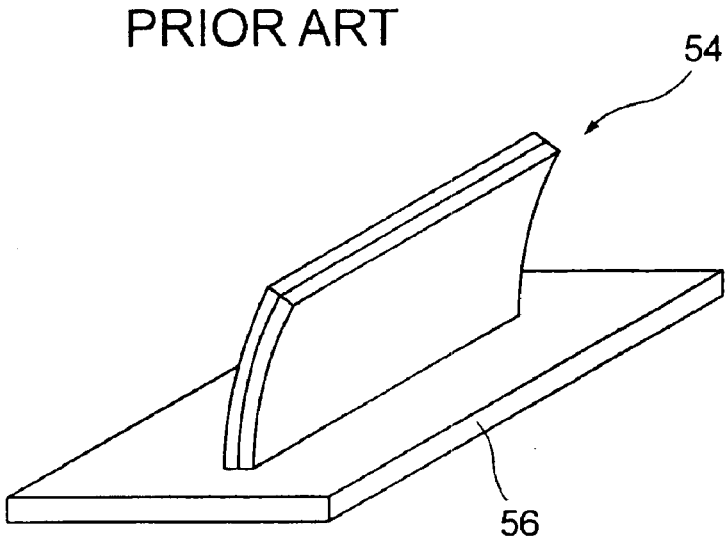
FIG. 7 is a perspective view of another example of conventional firing step of firing the unfired precursor to prepare the abrasive segment chip.
Figure 8:
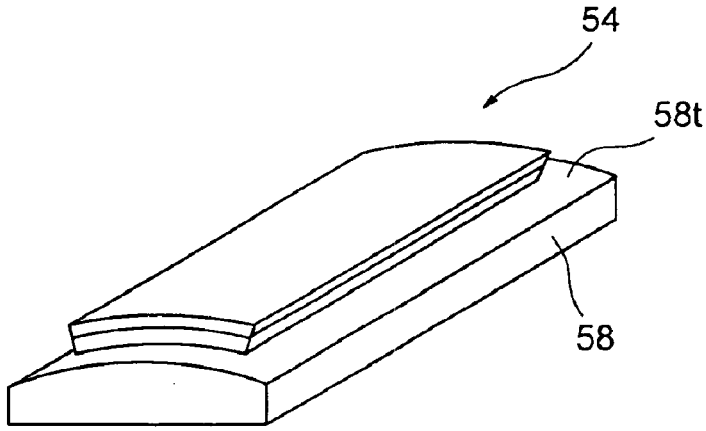
FIG. 8 is a perspective view showing a part of a grinding-wheel manufacturing method according to an embodiment of the present invention.

The cylindrical core body 14 is made of a material as used in a conventional alumina grindstone or silicon carbide grindstone. As shown in FIG. 5, each of the part-cylindrical abrasive segment chips 52 has a radially inner layer in the form of a base layer 52*a* which is bonded to the outer circumferential surface of the cylindrical core body 14, and a radially outer layer in the form of an abrasive layer 52*b* which is disposed radially outwardly of the base layer 52*a* and which is to be brought into contact with a workpiece during a grinding operation with the grinding wheel 50. The base layer 52*a* is formed of a mullite or other ceramic material. The abrasive layer 52*b* is formed of super abrasive grains, such as diamond abrasive grains and CBN (cubic boron nitrides) abrasive grains, which are held together by a vitrified bond or other bonding agent. The radially outer surfaces of the abrasive layers 52*b* cooperate with each other to form a cylindrical grinding surface of the grinding wheel 50, so that a cylindrical workpiece is ground by the cylindrical grinding surface while the grinding wheel 50 is rotated about its axis.

Figure 10:
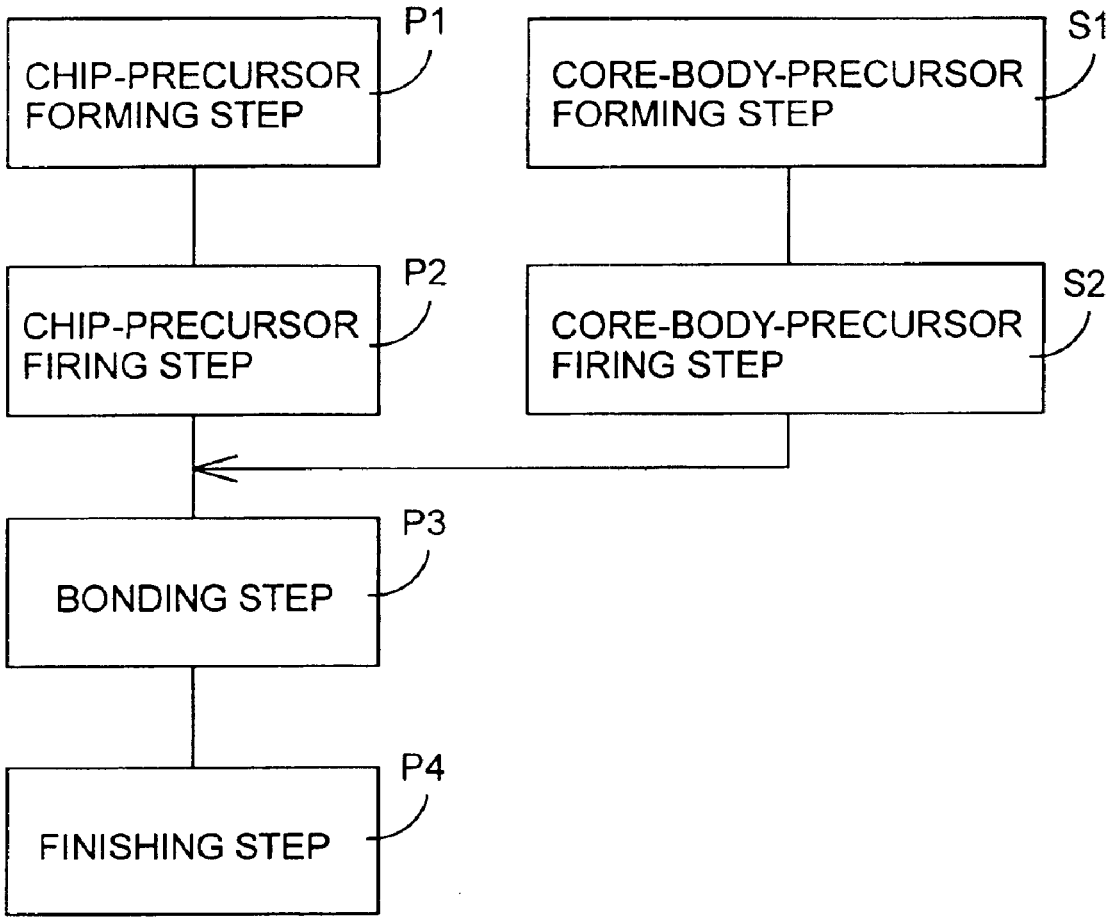
FIG. 10 is a flow chart showing steps of the manufacturing method of the embodiment of the invention.
Figure 11:
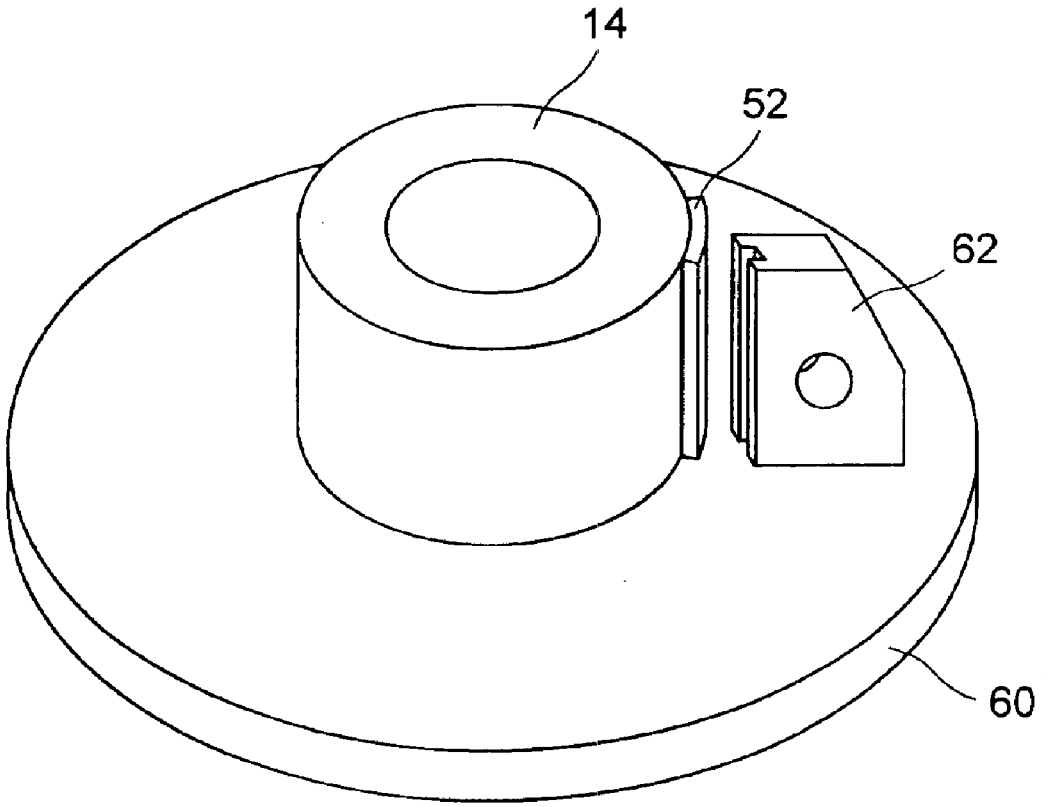
FIG. 11 is a perspective view showing a conventional technique for bonding the abrasive segment chip having a large length, to a cylindrical core body.

FIG. 10 is a flow chart for explaining a method of manufacturing the segment-chip-type grinding wheel 50, which method is of an embodiment of the present invention. The process is initiated with a chip-precursor forming step P1 in which the part-cylindrical precursor 54 of the abrasive segment chip 52 is formed by a press. Specifically described, a die is charged with a mixture of a ceramic material (e.g., mullite), a vitrified bond and a caking agent with a predetermined ratio therebetween, and the mixture is then compacted or pressed to form a precursor of the base layer 52*a* in the die. Subsequently, another mixture of super abrasive grains (e.g., diamond or CBN abrasive grains), a vitrified bond and a caking agent with a :predetermined ratio therebetween is put into the die, and the mixture is then compacted or pressed to form a precursor of the abrasive layer 52*b*. In this instance, the precursor of the abrasive layer 52*b* and the above-described precursor of the base layer 52*a* are integrated with each other, so that the part-cylindrical precursor 54 of the abrasive segment chip 52 is formed.

The chip-precursor forming step P1 is followed by a chip-precursor firing step P2 to fire the part-cylindrical precursor 54, which is laid on the part-cylindrical surface 58*t* of the setter 58 as a supporting member. The part-cylindrical surface 58*t* of the setter 58 is convexed so that the part-cylindrical precursor 54 is held in close contact at the radially inner surface with the part-cylindrical surface 58*t*. The setter 58 is made of a material having a coefficient of thermal expansion which is sufficiently different from a coefficient of thermal expansion of the abrasive segment chip 52. The coefficient of thermal expansion of the abrasive segment chip 52 is about $4.9\times10^{-6}$ (/° C.), which is close or substantially equal to a coefficient of thermal expansion of a material (such as mullite or silicon carbide) commonly used for an aggregate of a conventional setter. Where the coefficients of thermal expansion of the abrasive segment chip 52 and the setter are close to each other, the segment chip 52 is likely to adhere to the setter during the firing step.

In the present embodiment, the setter 58 used in the firing step is formed of alumina as its aggregate. Since the coefficient of thermal expansion of the alumina is about $7.4\times10^{-6}$ (/° C.) which is considerably different from that of the abrasive segment chip 52, there is no risk of adhesion of the abrasive segment chip 52 to the setter 58. Even if the segment chip 52 temporary adheres to the setter 58 during the firing step, the segment chip 52 is eventually separated from the setter 58 owing to the considerable difference between the coefficients of thermal expansion of the abrasive segment chip 52 and the setter 58. Thus, the abrasive segment chip 52 having a sufficiently length can be produced without suffering from adhesion of the segment chip 52 to the setter 58.

An experiment was made by the present inventors, to study a relationship between the coefficient of thermal expansion (/° C.) of the material of the setter 58 and an amount of deformation of the abrasive segment chip 52 caused in the firing step, and to check whether the segment chip 52 adheres to the setter 58 or not. A result of the experiment is indicated in the following Table 1. It is noted that the deformation amount of the abrasive segment chip 52 is represented by a maximum value of difference between a radius of curvature of the setter and that of the segment chip.

TABLE 1

| Material of Setter | Coefficient of Thermal Expansion (/° C.) | Deformation Amount (mm) | Adhesion |
|---|---|---|---|
| Alumina | $7.4 \times 10^{-6}$ | 0.05 | No |
| Mullite | $4.9 \times 10^{-6}$ | 0.06 | Yes |
| Silicon Carbide | $4.8 \times 10^{-6}$ | 0.08 | Yes |

As in indicated in Table 1, where the setter 58 is made of the material such as the mullite and silicon carbide whose coefficient of thermal expansion is substantially equal to that of the abrasive segment chip 52, the segment chip 52 is likely to adhere to the setter 58 since the behaviors of the setter 58 and the segment chip 52 are similar to each other in heating and cooling stages of the firing step. On the other hand, where the setter 58 is made of alumina whose coefficient of thermal expansion is higher than that of the segment chip 52 by $2.5\times10^{-6}$ (/° C.), the segment chip 52 does not adhere to the setter 58, and does not suffer from a large deformation during the firing step.

Before, after or concurrently with the above-described steps P1, P2, a core-body-precursor forming step S1 and a core-body-precursor firing step S2 are implemented to prepare the cylindrical core body 14. In the core-body-precursor forming step S1, a mixture of alumina abrasive grains (or silicon carbide abrasive grains), a vitrified bond and a caking agent with a predetermined ratio therebetween is put into a casting mold, so that a precursor of the core body is formed of the mixture. The formed precursor is removed from the mold, and is then fired in the core-body-precursor firing step S2. The cylindrical core body 14 is thus prepared.

Figure 12:
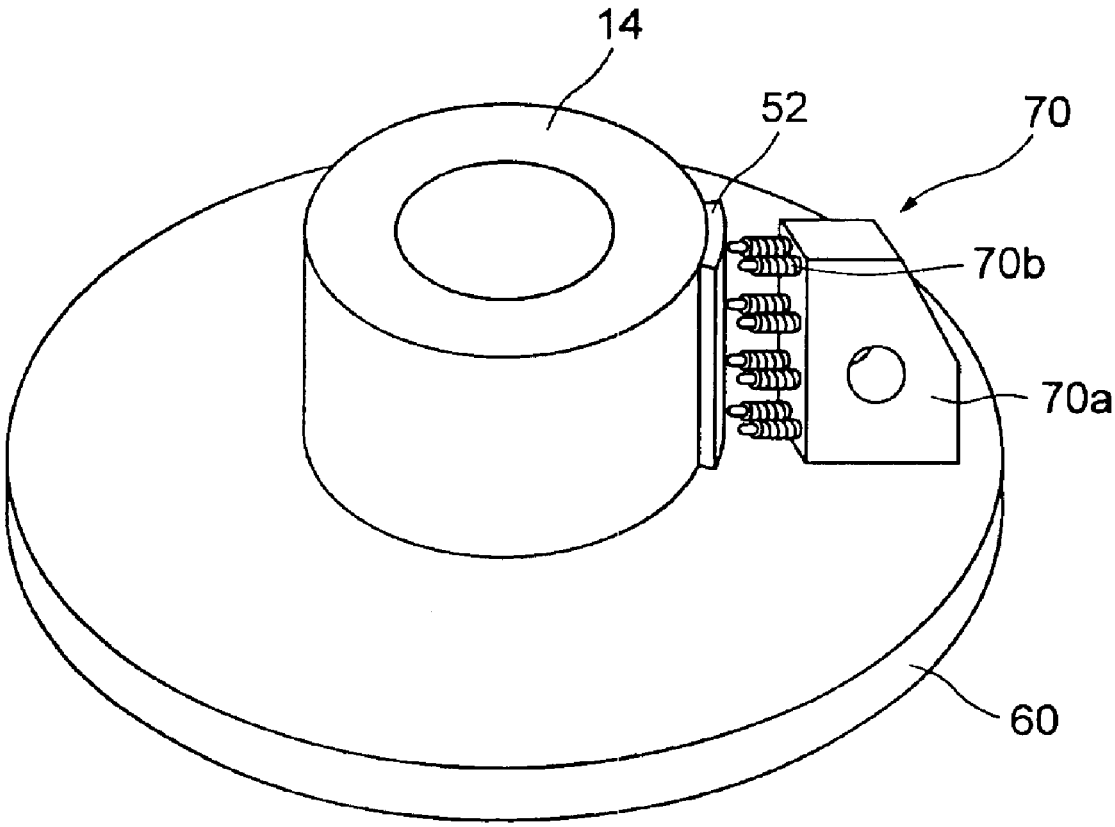
FIG. 12 is a perspective view showing a part of the grinding-wheel manufacturing method according to the embodiment of the present invention.

A bonding step P3 is implemented to bond the abrasive segment chip 52 (prepared in the steps P1, P2) and the cylindrical core body 14 (prepared in the steps S1, S2) to each other by an adhesive such as a two-liquid type epoxy resin bond. As shown in FIG. 12, in the bonding step P3, the core body 14, the abrasive segment chip 52 and a holding block 70 are disposed on the base plate 60 made of a metal such as a steel. The holding block 70 is moved to force the abrasive segment chip 52 against the outer circumferential surface of the core body 14 (which is held in contact at its axial end face with a surface of the base plate 60), such that the abrasive segment chip 52 is held in contact with the outer circumferential surface of the core body 14 via an adhesive. That is, the contact of the abrasive segment chip 52 with the core body 14 via the adhesive is held by the holding block 70, until the hardening of the adhesive is completed. In this instance, a force acting on the outer circumferential surface of the cylindrical core body 14 is substantially evenly distributed in the axial direction of the cylindrical core body 14. It is noted that the adhesive is used also for boding each segment chip 52 to the adjacent segment chip 52.

The holding block 70, serving as a holding member, includes a magnet portion 70*a* which can be fixed to the base plate 60 owing to a magnetic force, and an elastic portion 70*b* which is provided by a plurality of coil springs each having a spring constant of about 1.0 (kgf/mm). In the present embodiment, eight coil springs are fixed to a surface of the magnet portion 70*a* such that the eight coil springs are arranged in two lines and four rows. For forcing the abrasive segment chip 52 onto the outer circumferential surface of the cylindrical core body 14, the thus constructed holding block 70 is brought into contact at its elastic portion 70*b* with the abrasive segment chip 52, and is moved to force to force the abrasive segment chip 52 against the outer circumferential surface of the cylindrical core body 14, as shown in FIG. 12. In this instance, owing to the contact of the elastic portion 70*b* with the segment chip 52, the force acting on the outer circumferential surface of the cylindrical core body 14 is evenly forced in the axial direction of the cylindrical core body 14 while the adhesive is being hardened, whereby the segment chip 52 can be satisfactorily bonded to the outer circumferential surface of the core body 14 even if the segment chip 52 is distorted or bent by a small amount.

Another experiment was made by the present inventors, to study a relationship among the spring constant (kgf/mm) of the elastic portion 70*b* of the holding block 70, the bonding pressure or force (kgf/cm$^2$) applied between the segment chip 52 and the core body 14 by the holding block 70, and the bonding strength (kgf/cm$^2$) with which the segment chip 52 is bonded to the core body 14. The bonding strength was measured in a direction in which a shearing force is applied to the segment chip 52, after the segment chip 52 had been bonded to the core body 14. For facilitating this measurement of the bonding strength, the grinding wheel 50 is cut along a plane perpendicular to the height or axial direction of the grinding wheel 50. Dimensions of the grinding wheels are as follows:

Dimensions of the core body in the bonding step: 405 mm (outside diameter)×200 mm (axial length)×203.2 mm (inside diameter)

Dimensions of the bonded surface of the segment chip in the bonding step: 200 mm×40 mm Dimensions of the core body in the bonding strength measurement: 405 mm (outside diameter)×20 mm (axial length×203.2 mm (inside diameter)

Dimensions of the bonded surface of the segment chip in the strength measurement: 20 mm×40 mm A result of the experiment is indicated in the following Table 2.

TABLE 2

| Spring | Bonding | Bonding Strength (kgf/cm$^2$) | | |
|---|---|---|---|---|
| Constant (kg/mm) | Force (kgf/cm$^2$) | Average Value | Maximum Value | Minimum Value |
| No | — | 380 | 450 | 250 |
| 0.9 | 0.2 | 450 | 530 | 300 |
| 2.7 | 0.7 | 500 | 530 | 480 |
| 4.9 | 1.2 | 510 | 540 | 480 |

As is apparent from Table 2, the segment chip 52 can be bonded to the core body 14 with a sufficiently high bonding strength, by pressing the segment chip 52 against the core body 14 while maintaining the bonding force of at least 0.7 kgf/cm$^2$ or more preferably at least 1.0 kgf/cm$^2$.

The bonding step P3 is followed by a finishing step P4 in which the grinding wheel 50 is finished by using a finishing tool such as a dressing tool and a grinding tool, for adjusting its outside diameter, axial length and other dimensions and also for improving its roundness. Thus, by carrying out the manufacturing method of the present embodiment of the invention, it is possible to easily manufacture the segment-chip-type grinding wheel 50, as shown in FIG. 9, which has the joint lines extending in the axial direction but does not have any joint line extending in the circumferential direction, namely, which has the part-cylindrical abrasive segment chips 52 each extending over the entire axial length of the cylindrical core body 14.

Figure 1:
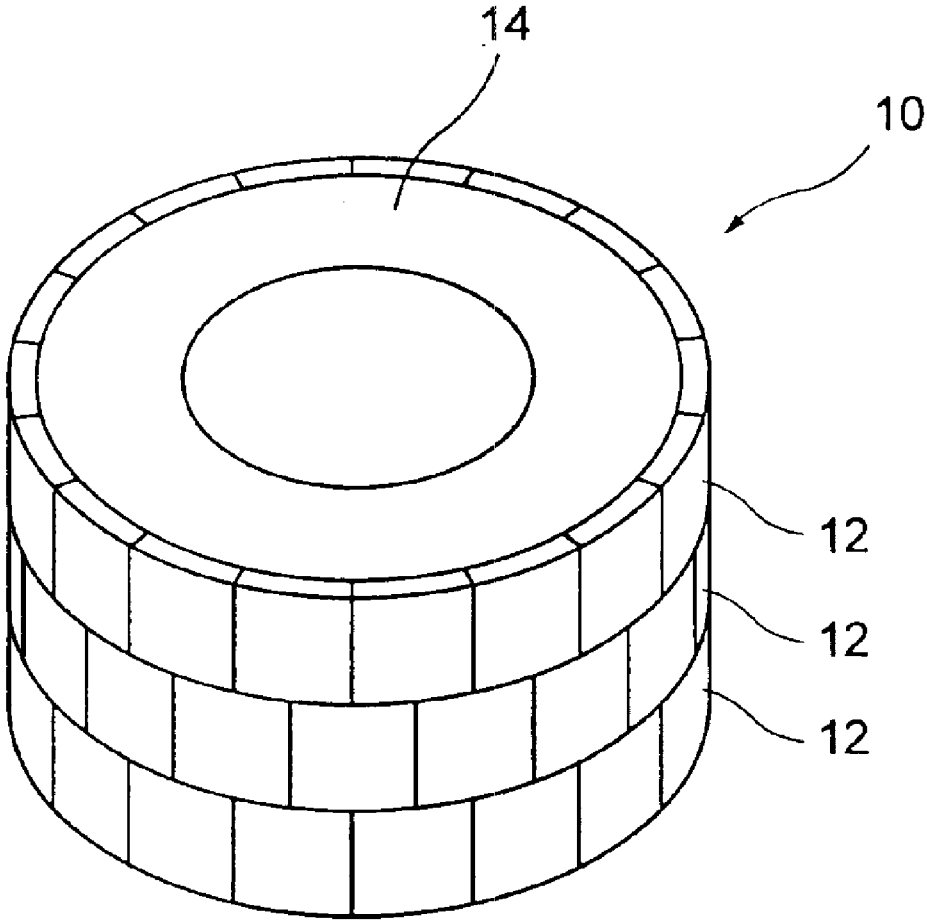
FIG. 1 PRIOR ART
FIG. 1 is a perspective view of one example of conventional segment-chip-type grinding wheel.
Figure 2:
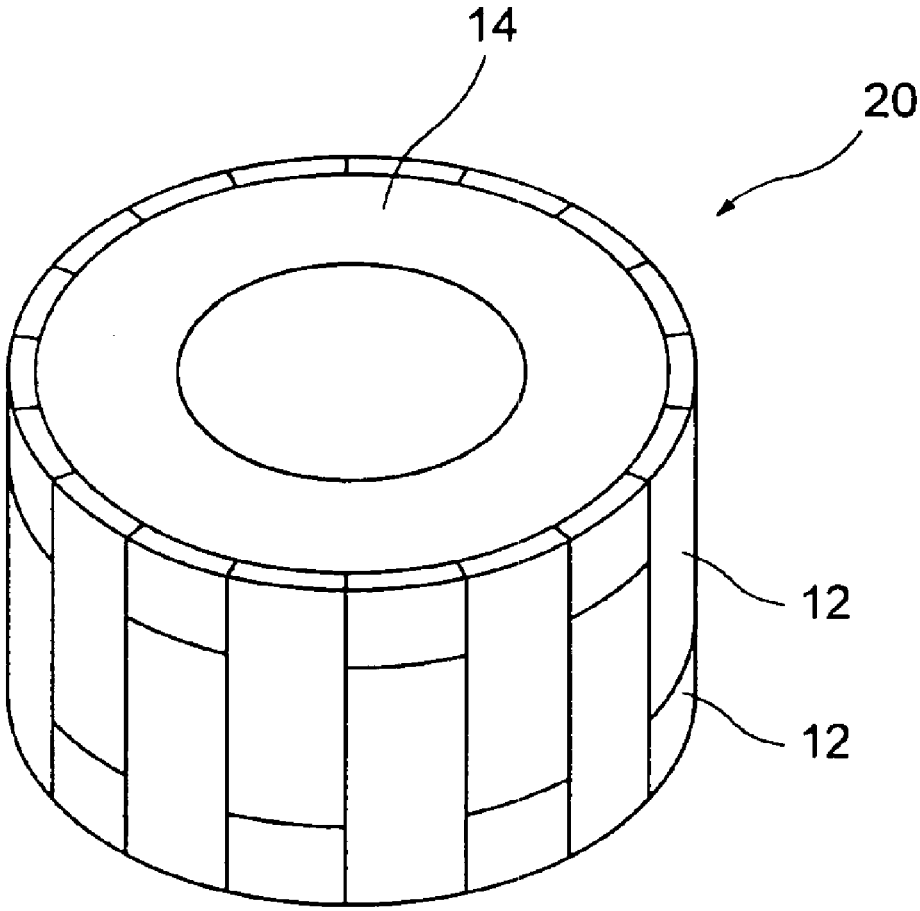
FIG. 2 PRIOR ART
FIG. 2 is a perspective view of another example of conventional segment-chip-type grinding wheel.
Figure 3:
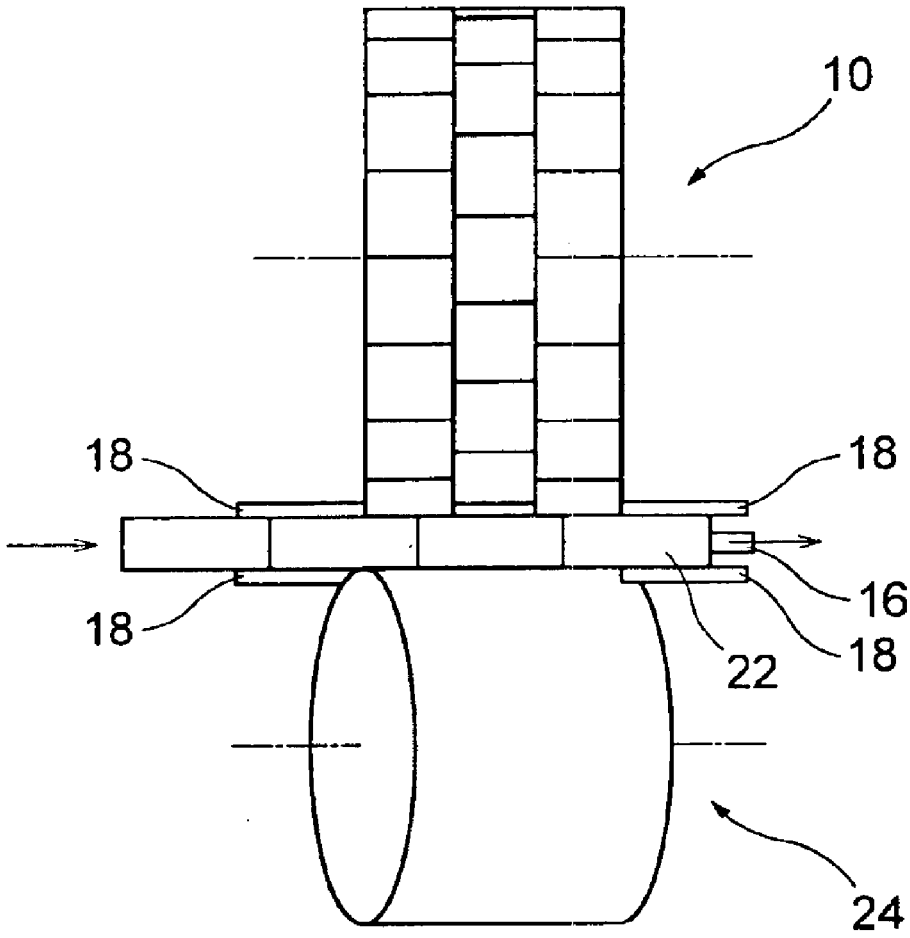
FIG. 3 is a plan view schematically showing a thru-feed centerless grinding operation.
Figure 4:
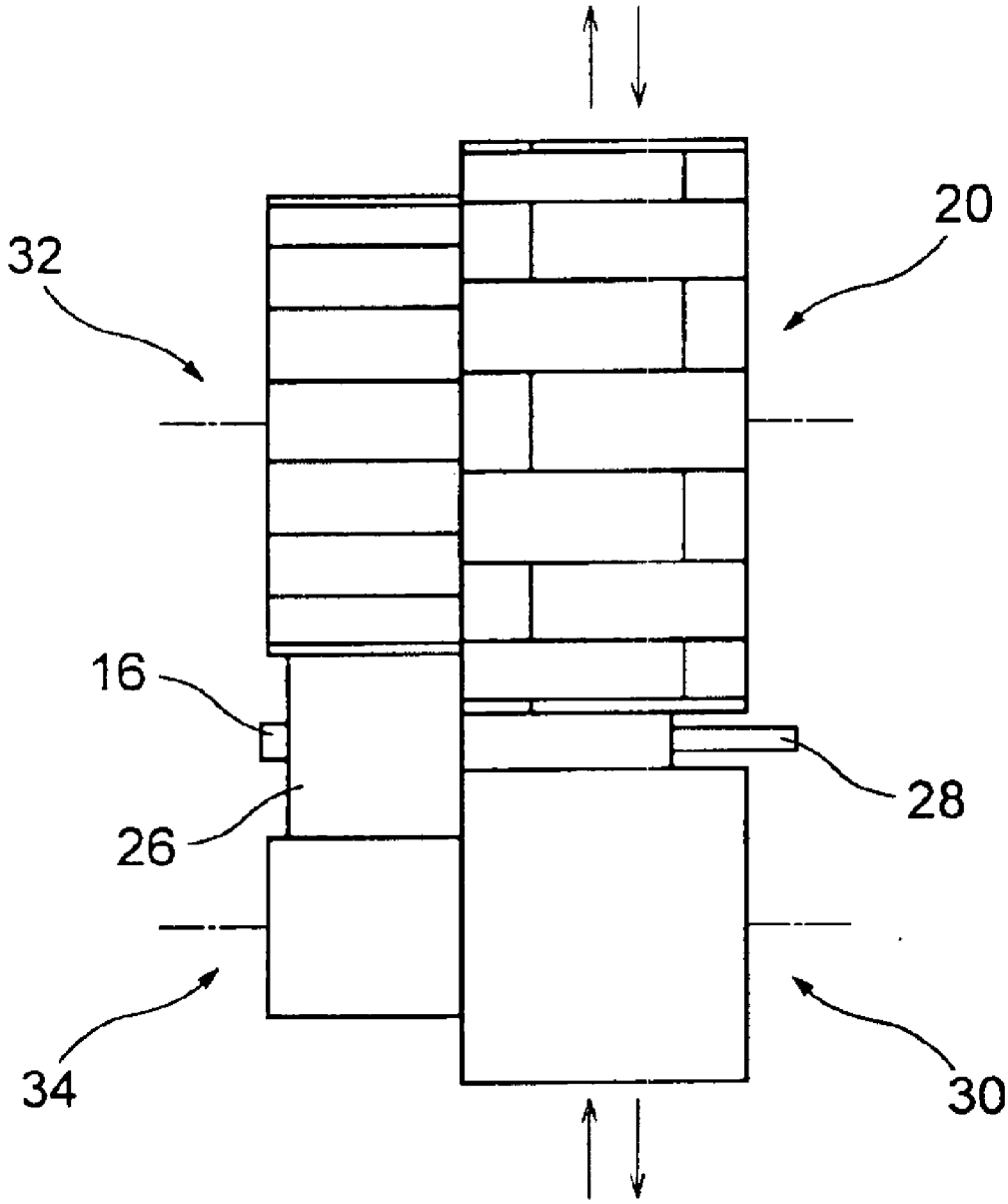
FIG. 4 is a plan view schematically showing a in-feed centerless grinding operation.

Still another experiment was made by the present inventors, to verify technical advantages of the present invention. In the experiment, using grinding wheels of Example and Comparative Example, grinding operations were performed on outer circumferential surfaces of cylindrical workpieces in a centerless grinding machine, in conditions as described below, so that the outside diameter of each workpiece was reduced by 0.02 mm. The Example was the segment-chip-type grinding wheel 50 of FIG. 9 manufactured in the above-described steps P1–P4 and S1–S2 of the manufacturing method according to the invention, while the Comparative Example was the conventional segment-chip-type grinding wheel 10 of FIG. 1 which has the joint lines extending in the circumferential direction as well as the joint lines extending in the axial direction. After the grinding operations with the grinding wheels 10, 50, the roundness of each of the workpieces was measured by measuring a maximum radial distance between a periphery of a circular cross section of each workpiece and a periphery of a circle circumscribed to the circular cross section. A result of the experiment is indicated in Table 3. It is noted that the number of the workpieces ground by each of the grinding wheels 10, 50 was 10,000, and that the roundness was measured every time 1,000 workpieces were ground.

[Conditions]

Code of grinding wheel: CBN120M200V

Dimensions of grinding wheel: 405 mm (outside diameter)×200 mm (axial length)×203.2 mm (inside diameter)

Dimensions of workpiece: 2 mm (outside diameter)×10 mm (axial length)

Material of workpiece: SUJ2

TABLE 3

| | Roundness (μm) of Workpiece | | |
|---|---|---|---|
| | Average Value | Maximum Value | Minimum Value |
| Example | 0.8 | 0.7 | 0.9 |
| Comparative Example | 0.9 | 0.7 | 1.2 |

As is apparent from Table 3, there was a small variation in the roundness of the workpieces ground by the Example in the form of the grinding wheel 50. That is, the grinding wheel 50 exhibited a stable grinding performance. On the other hand, the maximum value of the roundness of the workpieces grounded by the Comparative Example in the form of the grinding wheel 10 was as large as 1.2 μm. This large value was caused by undesirable marks, which were generated (due to the circumferentially-extending joint lines on the grinding surface of the grinding wheel 10) on the ground surface of the workpiece when the number of workpieces ground by the grinding wheel 10 became close to 10,000.

In the manufacturing method according to the present embodiment of the invention in which the unfired part-cylindrical precursor 54 of the segment chip 52 is fired while being supported by the setter 58 made of the material having the coefficient of thermal expansion that is sufficiently different from the coefficient of thermal expansion of the segment chip 52 (or the precursor 54), it is possible to prevent the segment chip 52 (or the precursor 54) from adhering to the setter 58, with which the part-cylindrical surface of the segment chip 52 (or the precursor 54) is held in close contact during the firing step.

Further, in the manufacturing method according to the present embodiment of the invention, the abrasive segment chip 52 (or the precursor 54) is forced against the outer circumferential surface of the cylindrical core body 14 by using the holding block 70 having the construction permitting the force to act on the outer circumferential surface of the cylindrical core body 14 such that the force is evenly distributed in the axial direction in the process of hardening of the adhesive. This arrangement makes it possible to satisfactorily bond the abrasive segment chip 52 to the outer circumferential surface of the core body 14 even where the abrasive segment chip 52 is slightly distorted or bent.

The manufacturing method of the present embodiment of the invention permits each abrasive segment chip 52 to have a length large enough to extend over the entire axial length of the cylindrical core body 14, thereby making it possible to provide the segment-chip-type grinding wheel 50 in which there does not exist any joint lines extending in the circumferential direction.

While the presently preferred embodiment of the present invention has been described above with a certain degree of particularity, by reference to the accompanying drawings, it is to be understood that the invention is not limited to the details of the illustrated embodiment, but may be otherwise embodied.

While the elastic portion 70*b* of the holding block 70 is provided by the plurality of coil springs fixed to the surface of the magnet portion 70*a* in the above-illustrated embodiment, the elastic portion 70*b* may be provided by an elastic member such as a rubber.

While the holding member is provided by the holding block 70 designed to be brought into pressing contact with a single one of the segment chips 52 in the above-illustrated embodiment, the holding member may be provided by a tubular body having a hole whose diameter is larger than the outside diameter of the grinding wheel 50. In this case, the tubular body may have an annular elastic portion provided by its radially inner portion, so that all the segment chips 52 are concurrently forced against the outer circumferential surface of the core body 14 by the tubular body which is disposed radially outwardly of the grinding wheel 50. The annular elastic portion may be provided by, for example, an annular rubber tube whose volume is increasable by supplying a gas into the annular rubber tube, so that the segment chips 52 can be forced against the core body 14 owing to a pressure of the gas accommodated in the annular tube.

While the part-cylindrical surface 58*t* of the setter 58 is convexed so that the part-cylindrical precursor 54 is held in close contact at the radially inner surface with the part-cylindrical surface 58*t* in the above-illustrated embodiment, the part-cylindrical surface 58*t* of the setter 58 may be concaved so that the part-cylindrical precursor 54 is held in close contact at the radially outer surface with the part-cylindrical surface 58*t*.

While each abrasive segment chip 52 is constituted by the base layer 52*a* and the abrasive layer 52*b* in the above-illustrated embodiment, the principle of the invention is applicable to an abrasive segment chip which is constituted exclusively by the abrasive layer.

While the presently preferred embodiment of the present invention has been illustrated above, it is to be understood that the invention is not limited to the details of the illustrated embodiment, but may be embodied with various other changes, modifications and improvements, which may occur to those skilled in the art, without departing from the spirit and scope of the invention defined in the following claims.

What is claimed is:

1. A method of manufacturing a grinding wheel which includes a cylindrical core body and a plurality of part-cylindrical abrasive segment chips bonded to an outer circumferential surface of said cylindrical core body, said method comprising:

a forming step of forming an unfired part-cylindrical precursor for each of said part-cylindrical abrasive segment chips, by pressing a mixture including abrasive grains, a vitrified bond, and a caking agent;

a firing step of firing said unfired part-cylindrical precursor to prepare said each of said part-cylindrical abrasive segment chips, by using a supporting member which has a part-cylindrical surface with which said part-cylindrical surface of the part-cylindrical precursor is held in close contact during said firing step, and a bonding step of bonding said plurality of part-cylindrical abrasive segment chips to said outer circumferential surface of said cylindrical core body, wherein said unfired part-cylindrical precursor is fired, while being supported by said supporting member such that said unfired part-cylindrical precursor is held in contact at a part-cylindrical surface thereof with said part-cylindrical surface of said supporting member, and wherein said supporting member is made of a material having a coefficient of thermal expansion which is different from a coefficient of thermal expansion of said each of said part-cylindrical abrasive segment chips, so as to prevent from adhering the part-cylindrical abrasive segment chips to the supporting member.

2. A method according to claim 1, wherein said coefficient of thermal expansion of said material of said supporting member is different from said coefficient of thermal expansion of said each of said part-cylindrical abrasive segment chips, by an amount large enough to prevent said unfired part-cylindrical precursor from adhering to said supporting member.

3. A method according to claim 1, wherein said coefficient of thermal expansion of said material of said supporting member is larger than said coefficient of thermal expansion of said each of said part-cylindrical abrasive segment chips, by an amount large enough to prevent said unfired part-cylindrical precursor from adhering to said supporting member.

4. A method according to claim 1, wherein each of said part-cylindrical abrasive segment chips extends over an axial length of said grinding wheel.

5. A method according to claim 1, wherein each of said part-cylindrical abrasive segment chips includes an abrasive layer having a vitrified abrasive structure in which diamond abrasive grains are held together by a vitrified bond.

6. A method according to claim 1, wherein each of said part-cylindrical abrasive segment chips includes an abrasive layer having a vitrified abrasive structure in which CBN abrasive grains are held together by a vitrified bond.

7. A method according to claim 1, wherein said material of said supporting member is alumina.

8. A method according to claim 1, further comprising:

a separating step of separating said abrasive segment chips from said part-cylindrical surface of said supporting member prior to said bonding step, wherein said bonding step bonds said abrasive segment chips to said outer circumferential surface of said cylindrical core body with an adhesive interposed therebetween, by forcing each of said abrasive segment chips against said outer circumferential surface of said cylindrical core body, such that a force acting on said outer circumferential surface of said cylindrical core body is evenly distributed in an axial direction of said cylindrical core body while said adhesive is being hardened.

9. A method according to claim 8, wherein said each of said abrasive segment chips is forced against said outer circumferential surface of said cylindrical core body, by using a holding member which includes a main body portion and an elastic portion which is provided by a plurality of springs each having a same spring constant, and wherein said holding member is brought into contact at said elastic portion with said each of said abrasive segment chips, and is moved to force said each of said abrasive segment chips against said outer circumferential surface of said cylindrical core body.

10. A method according to claim 8, wherein each of said part-cylindrical abrasive segment chips extends over an axial length of said grinding wheel.

11. A method according to claim 8, wherein each of said part-cylindrical abrasive segment chips includes an abrasive layer having a vitrified abrasive structure in which diamond abrasive grains are held together by a vitrified bond.

12. A method according to claim 8, wherein each of said part-cylindrical abrasive segment chips includes an abrasive layer having a vitrified abrasive structure in which CBN abrasive grains are held together by a vitrified bond.

* * * * *